US009084481B2

(12) United States Patent
Hollenstein

(10) Patent No.: US 9,084,481 B2
(45) Date of Patent: Jul. 21, 2015

(54) PIECE OF FURNITURE COMPRISING AN INNER BODY THAT CAN BE RAISED AND LOWERED, AND LEAF FOR COVERING SAME

(71) Applicant: Julius Blum GmbH, Hoechst (AT)

(72) Inventor: Helmut Hollenstein, Lustenau (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

(21) Appl. No.: 14/190,589

(22) Filed: Feb. 26, 2014

(65) Prior Publication Data

US 2014/0175962 A1 Jun. 26, 2014

Related U.S. Application Data

(63) Continuation of application No. PCT/AT2012/000217, filed on Aug. 23, 2012.

(30) Foreign Application Priority Data

Sep. 2, 2011 (AT) ..... A 1256/2011

(51) Int. Cl.
*A47B 51/00* (2006.01)

(52) U.S. Cl.
CPC ..... *A47B 51/00* (2013.01)

(58) Field of Classification Search
CPC ..... A47B 51/00
USPC ..... 312/312, 306, 319.4–319.8, 247, 327, 312/325, 328, 310, 270.3, 270.1, 271, 312/272.5, 272, 21, 29, 295, 298
See application file for complete search history.

(56) References Cited

U.S. PATENT DOCUMENTS

| | | | | |
|---|---|---|---|---|
| 3,415,586 | A * | 12/1968 | Hammond | 312/312 |
| 5,273,352 | A * | 12/1993 | Saper | 312/7.2 |
| 6,471,311 | B1 * | 10/2002 | Snyder | 312/247 |
| 6,755,492 | B1 * | 6/2004 | Hyde et al. | 312/247 |
| 7,396,093 | B2 * | 7/2008 | Jeong et al. | 312/402 |

(Continued)

FOREIGN PATENT DOCUMENTS

| | | |
|---|---|---|
| AT | 009 076 | 4/2007 |
| AT | 507 804 | 8/2010 |

(Continued)

OTHER PUBLICATIONS

International Search Report (ISR) issued Jan. 18, 2013 in International (PCT) Application No. PCT/AT2012/000217.

(Continued)

*Primary Examiner* — Janet M Wilkens
*Assistant Examiner* — Hiwot Tefera
(74) *Attorney, Agent, or Firm* — Wenderoth, Lind & Ponack, L.L.P.

(57) ABSTRACT

A piece of furniture has an outer construction (frame), an inner body that can be raised and lowered in relation to the outer construction via a body motor, and a leaf (flap) that is movable via a leaf motor for covering the front face of the raised inner body. The leaf is articulated on the outer construction, and an electronic controller operable by way of at least one operating switch is provided for coordinated actuation of the leaf motor and the body motor. Starting from a position with the leaf open and the inner body lowered, the inner body first moves at least partially upwards before the leaf closes in order to close the piece of furniture.

17 Claims, 5 Drawing Sheets

(56) References Cited

U.S. PATENT DOCUMENTS

| | | | | |
|---|---|---|---|---|
| 8,052,230 | B2 * | 11/2011 | Vicek | 312/247 |
| 8,056,991 | B2 * | 11/2011 | Hollenstein | 312/312 |
| 8,066,342 | B2 * | 11/2011 | Hwang | 312/405.1 |
| 8,276,857 | B2 * | 10/2012 | Cvek | 248/132 |
| 8,579,390 | B2 * | 11/2013 | Bruestle et al. | 312/247 |
| 8,641,156 | B2 * | 2/2014 | Chow | 312/247 |
| 2004/0090154 | A1 * | 5/2004 | Chang | 312/223.3 |
| 2006/0000955 | A1 * | 1/2006 | Cvek | 248/161 |
| 2006/0255697 | A1 * | 11/2006 | Smieszek et al. | 312/21 |
| 2007/0240347 | A1 * | 10/2007 | Chang | 40/601 |
| 2007/0241650 | A1 * | 10/2007 | Schmitt | 312/312 |
| 2009/0134753 | A1 | 5/2009 | Wenzel et al. | |
| 2010/0066220 | A1 * | 3/2010 | Grimm | 312/237 |
| 2010/0072870 | A1 * | 3/2010 | Hwang | 312/405 |
| 2011/0068669 | A1 * | 3/2011 | Hollenstein | 312/319.1 |
| 2011/0221317 | A1 * | 9/2011 | Bruestle et al. | 312/247 |
| 2011/0266936 | A1 * | 11/2011 | Moran | 312/312 |
| 2013/0241384 | A1 * | 9/2013 | Strauss et al. | 312/319.5 |
| 2013/0334944 | A1 * | 12/2013 | Karg | 312/237 |

FOREIGN PATENT DOCUMENTS

| | | |
|---|---|---|
| CN | 1250735 | 4/2000 |
| CN | 101420883 | 4/2009 |
| CN | 101677684 | 3/2010 |
| CN | 102046044 | 5/2011 |
| JP | 2009-297271 | 12/2009 |
| WO | 2007/131251 | 11/2007 |
| WO | 2010/081180 | 7/2010 |

OTHER PUBLICATIONS

Austrian Patent Office Search Report (ASR) issued Mar. 30, 2012 in Austrian Patent Application No. A 1256/2011.

Chinese Office Action (OA) and Search Report (SR) issued Mar. 23, 2015 in counterpart Chinese Patent Application No. 201280042163.5.

* cited by examiner

PIECE OF FURNITURE COMPRISING AN INNER BODY THAT CAN BE RAISED AND LOWERED, AND LEAF FOR COVERING SAME

BACKGROUND OF THE INVENTION

The invention concerns an article of furniture comprising an external structure, an inner body which can be raised and lowered motor-driven by way of a body motor in relation to the external structure, and a moveable flap motor-driven by way of a flap motor for covering the front side of the upwardly moved inner body, wherein the flap is articulated on the external structure.

It should be noted that the terms "body motor" and "flap motor" refer in that case not just to a pure motor but also to the peripheral devices which are usually employed by a man skilled in the art for technical implementation of a motor movement, like for example a suitable transmission device, that is to say they refer to the entire motorized drive unit.

In addition, it should also be first pointed out that the invention is not limited to an article of furniture with a given type of inner body or flap. The flap can be, for example, an upwardly moveable flap in regard to which in turn a distinction is essentially made between one-piece high-level flaps, so-called upwardly foldable flaps comprising at least two flap portions, one-piece upwardly pivotable flaps or so-called upward lift flaps (see in that respect for example AT 009 076 U1).

The articles of furniture set forth in the opening part of this specification are known for example from AT 507 804 A1 to the present applicant, wherein the invention disclosed in that specification is directed in particular to optimizing the basic structure of such articles of furniture in regard to fitment thereof to a wall.

Similar structures are described in JP 2009 297271 A and WO 2007 131251 A2.

SUMMARY OF THE INVENTION

The object of the present invention is now to improve safety and at the same time operating comfort for the user. For example, it was hitherto not possible to entirely exclude the risk of fingers becoming jammed between the flap and the inner body of the article of furniture by a relative movement of those two components with respect to each other.

Therefore, a basic idea of the invention involves actuating the flap motor and the body motor in coordinated relationship.

That coordinated actuation can be promoted by the provision of a device connected to the control device for detecting the height-wise position of the inner body. More specifically, the control device can then actuate the flap motor and the body motor in coordinated relationship in dependence on the detected height-wise position of the inner body. The height-wise position specifies the height-wise position in which the inner body is disposed relative to the article of furniture. The device for detecting that height-wise position can be different sensors which are usually employed for that purpose by a man skilled in the art. As an alternative thereto, the body motor itself can also function as such a device, more specifically when for example this involves a stepping motor, the number of revolutions of which is detected and related to the travel distance covered by the inner body.

To exclude the risk, referred to in the opening part of this specification, of fingers becoming jammed between the flap and the inner body of the article of furniture due to a relative movement of those two components with respect to each other, it is advantageous when closing the article of furniture—starting from a position with the flap open and the inner body moved downwardly—that firstly the inner body moves at least partially upwardly before the flap closes. As an alternative thereto, both movements—that is to say the upward movement of the inner body and closure of the flap—can also begin at the same time. In that case, however, the speed of the closing movement of the flap is reduced to such an extent that the upward travel movement of the inner body is ended before the flap finally closes.

In regard to the above-mentioned operating comfort for the user, it has proven to be desirable if closure of the article of furniture can be triggered in the above-described manner by a one-off actuation of only one actuating switch.

The coordinated actuation of the flap motor and the body motor—besides the possibility of providing a device for detecting the height-wise position of the inner body—can also be still further promoted if there is provided a device connected to the control device, for detecting the position of the flap. In relation to the possible technical implementations of such a device, different sensors are also presented here, as well as the possibility of determining the instantaneous flap position indirectly by way of detection of the number of revolutions of the flap motor.

To further increase safety, it is advantageous if the downward movement of the inner body is prevented when the flap is closed. That can be achieved for example by way of the electronic control device and/or by virtue of an actuating switch, by means of which the downward movement of the inner body can be triggered, being concealed by the flap when the flap is closed and thus not being accessible from the exterior.

An advantageous embodiment of the invention is characterised in that opening of the flap, downward and upward movement of the inner body and/or closure of the article of furniture (in the above-described manner) can be triggered by actuation of an actuating switch. This case therefore involves a "one-switch operating mode". In that case, specific triggering of the above-mentioned processes can be effected by actuations that last for different periods of time and/or different sequences of actuating pulses of the actuating switch. It is for example conceivable that—starting from a closed flap and an upwardly moved inner body—the first actuation of the actuating switch (irrespective of how long it lasts) always opens the flap. As from a given moment in time, that is to say from a given position of the flap, the actuating switch is released again for renewed actuation. The nature of this renewed actuation now decides whether the flap closes again or the inner body moves downwardly. For example, a brief actuation can cause closure of the flap and a long actuation can cause downward movement of the inner body, or vice-versa. As an alternative thereto, the distinction can also be made by way of a different number of actuating pulses in a predetermined time window. In the downwardly moved condition of the inner body, it is possible for the user to again be allowed to decide (by differing actuation of the actuating switch) whether he would now want to only move the inner body upwardly or whether in addition the flap is also to be closed (in the above-described manner).

A further advantageous embodiment of the invention is characterised in that there are provided at least two actuating switches, and

- opening and closing of the flap can be triggered by actuation of one of the at least two actuating switches, and
- upward and downward movement of the inner body can be triggered by actuation of the other of the at least two actuating switches.

In addition, by actuation of the actuating switch, by the actuation of which opening and closing of the flap can be triggered, closing of the article of furniture can also be triggered (in the above-described manner).

Particularly in the case of articles of furniture with a large inner body, it is possible to provide two such respective actuating switches at the left-hand and right-hand sides of the article of furniture—in the position of use. The two actuating switches for example are arranged one above the other on the two sides, and the two upper switches are characterised by a given functionality—and more specifically the same one. The two lower switches are characterised by another functionality—which however is also the same in respect of those two lower switches. That configuration has the advantage that, to operate the article of furniture, the user can select that two-switch group of actuating switches, which is disposed closer to where he is.

A very elegant structure is characterised in that at least one actuating switch, and more specifically preferably that which triggers opening of the flap when the flap is closed and the inner body is moved upwardly, bears at least region-wise against the inside surface of the flap when the flap is closed, and is actuable by external pressure on the flap.

In addition, it is advantageous if

- the at least one actuating switch or at least one of the provided actuating switches is a pushbutton switch, and/or
- the body motor and/or the flap motor is an electric motor, and/or
- the front side of the inner body is at least region-wise open, and/or
- the inner body has at least one compartment shelf.

BRIEF DESCRIPTION OF THE DRAWINGS

Further details and advantages of the present invention will be described more fully hereinafter by means of the specific description with reference to the embodiments by way of example illustrated in the drawings, in which.

DETAILED DESCRIPTION OF THE INVENTION

Figure 1B:
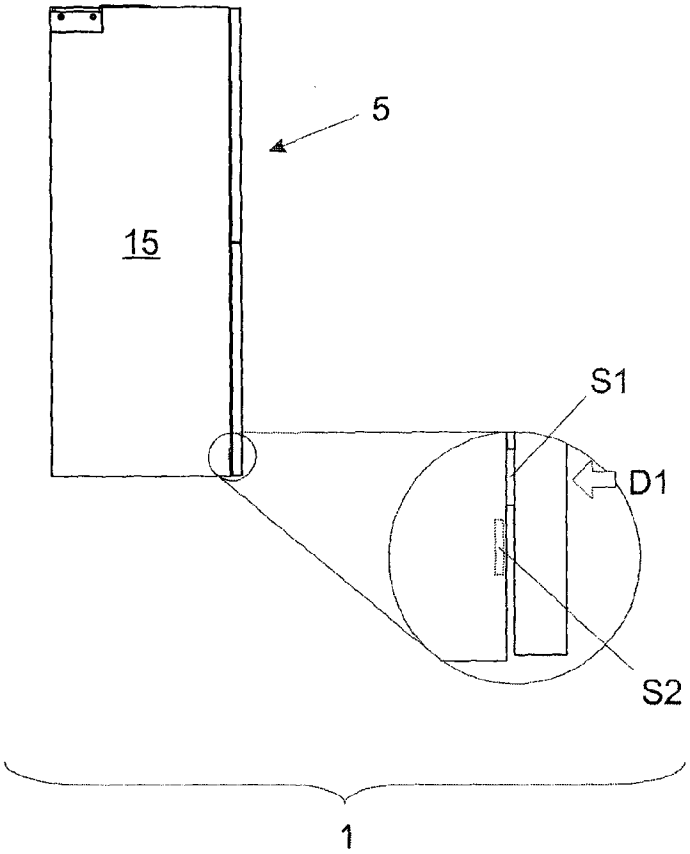
FIGS. 1*a* and 1*b* are diagrammatic views of a preferred embodiment of the article of furniture with the flap closed and the inner body moved upwardly, FIG. 1*a* being a perspective view and FIG. 1*b* being a side view.
Figure 1A:
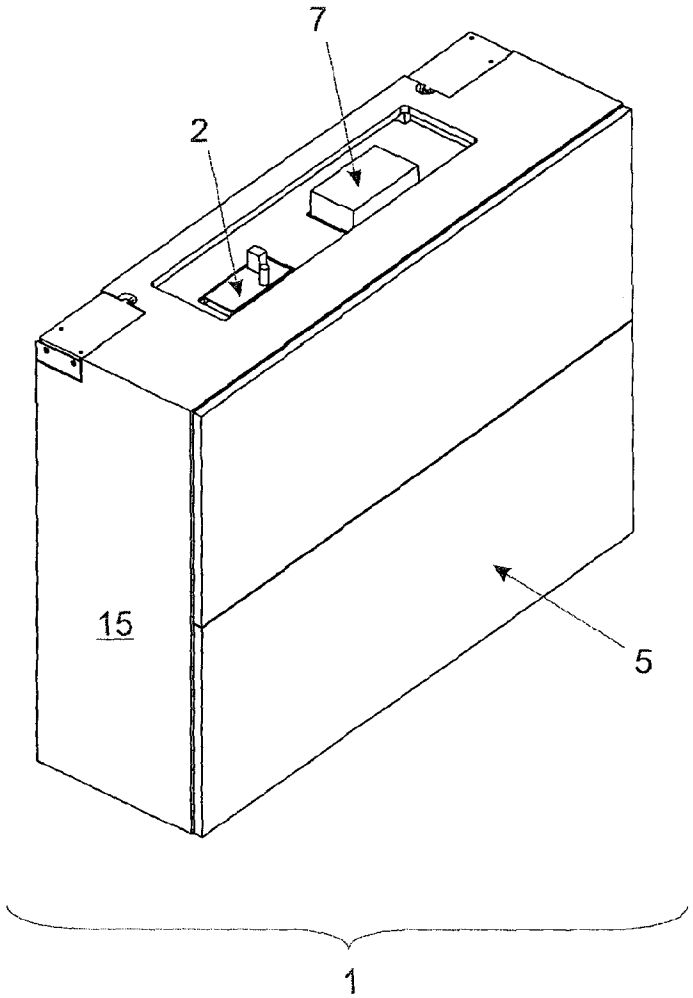

FIGS. 1*a* through 4*b* show various conditions of the preferred embodiment of the article of furniture 1 during the opening and closing movements. In that respect, FIGS. 1*a* and 1*b* show the completely closed condition (i.e., the condition in which the inner body is moved completely upwardly and is concealed by the completely closed flap 5). FIG. 1*a* is a perspective view while FIG. 1*b* is a side view of the article of furniture 1 in that condition. It is possible to see: an external frame structure 15, the flap 5 which in this case is an upward fold flap made in two parts, a part of the body motor 2 and a power supply device 7 which supplies electric energy to the two motors and the electronic control device as well as all further electronic components of the article of furniture 1.

In the enlarged portion of the side view (see FIG. 1*b*), it is possible to see two actuating switches S1 and S2 provided for operation of the electronic control device. The particularity in regard to the arrangement of these two actuating switches S1 and S2 is that they are concealed by the flap 5 when the flap 5 is closed. In addition, the switch S1 bears against the inside surface of the flap 5 and can be actuated by an external pressure D1 on the flap 5. The switch S2 in contrast is arranged within the external frame structure 15 and is therefore only indicated in broken line in FIG. 1*b*. If now there should be a wish to open the flap 5 of the article of furniture 1, then a brief pressure movement D1 from the exterior on the flap 5 is sufficient to actuate the switch S1 and thereby set in operation the opening mechanism of the flap 5.

Figure 2B:
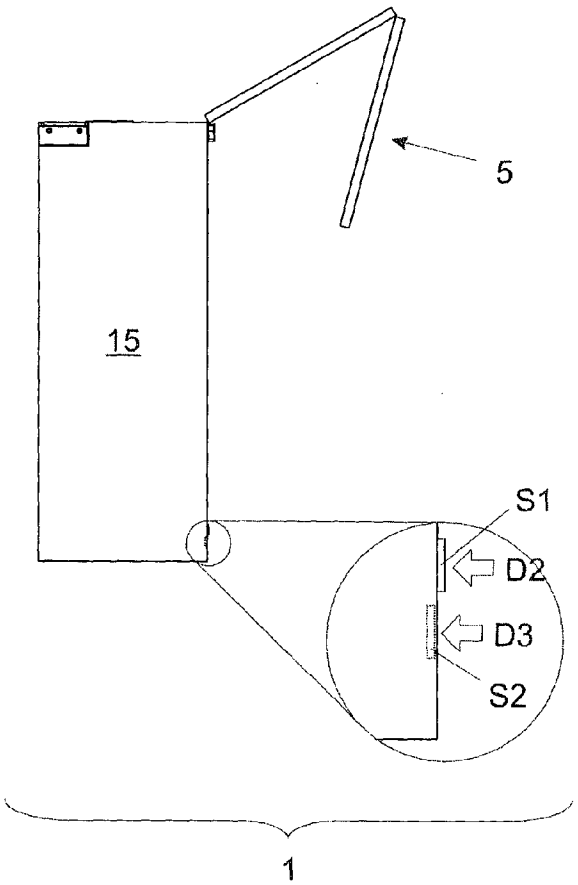
FIGS. 2*a* and 2*b* are diagrammatic views of the preferred embodiment of the article of furniture with the flap open and the inner body moved upwardly, FIG. 2*a* being a perspective view and FIG. 2*b* being a side view.
Figure 2A:
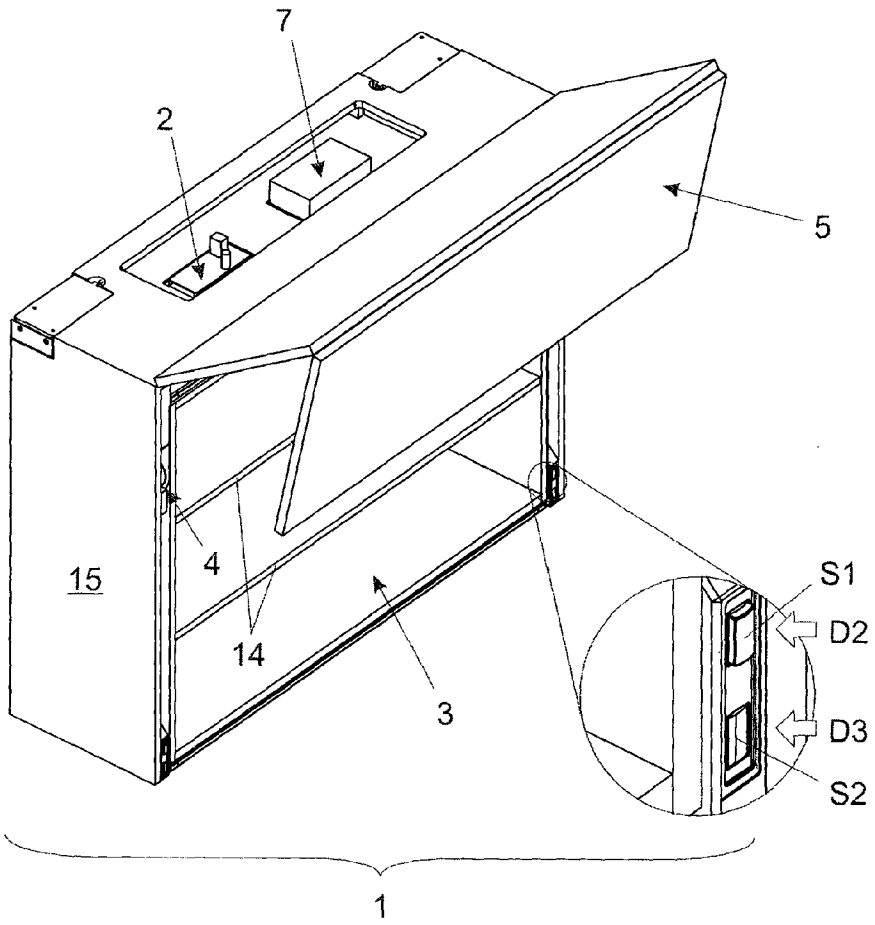

Both of FIGS. 2*a* and 2*b* show the condition of the article of furniture 1 with the flap 5 completely open, more specifically also once again as a perspective view and a side view. As the flap 5 is now open, the observer can look into the inside of the article of furniture 1 and in so doing see a part of the flap motor 4, the inner body 3, the two compartment shelves 14 and now also in the perspective view the two actuating switches S1 and S2. Those two actuating switches S1 and S2 are arranged both at the left-hand and also at the right-hand side of the article of furniture 1. That configuration has the advantage that for operation of the article of furniture, the user can select that two-switch group of actuating switches S1 and S2, which is closer to where he is. By virtue of that duplication of the actuating switches S1 and S2—particularly in the case of articles of furniture 1 with a large inner body 3, it does not matter at what location on the flap 5 the initial opening pressure command D1 is exerted as in any case one of the two switches S1 arranged at both sides will respond to that pressure D1.

Starting from that open condition of the article of furniture 1, the user has the possibility either of closing the flap 5 again by renewed—but this time direct—actuation D2 of the actuating switch S1, or in some manner causing the inner body 3 to move downwardly in order to more easily put articles into it or remove them therefrom. If the user should want to trigger the latter movement, he can do that by actuation D3 of one of the two switches S2.

Figure 3B:
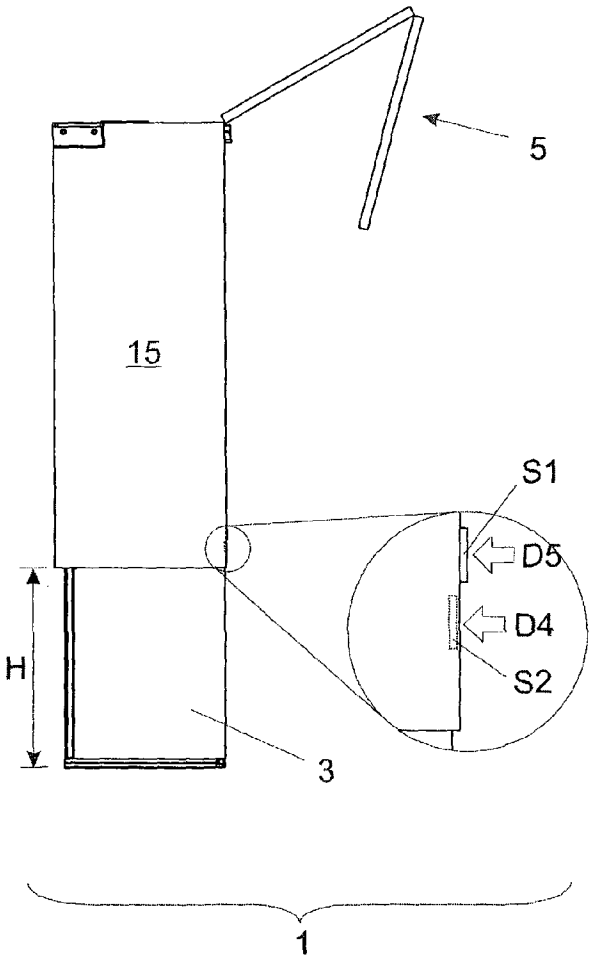
FIGS. 3*a* and 3*b* are diagrammatic views of the preferred embodiment of the article of furniture with the flap open and the inner body moved downwardly, FIG. 3*a* being a perspective view and FIG. 3*b* being a side view.
Figure 3A:
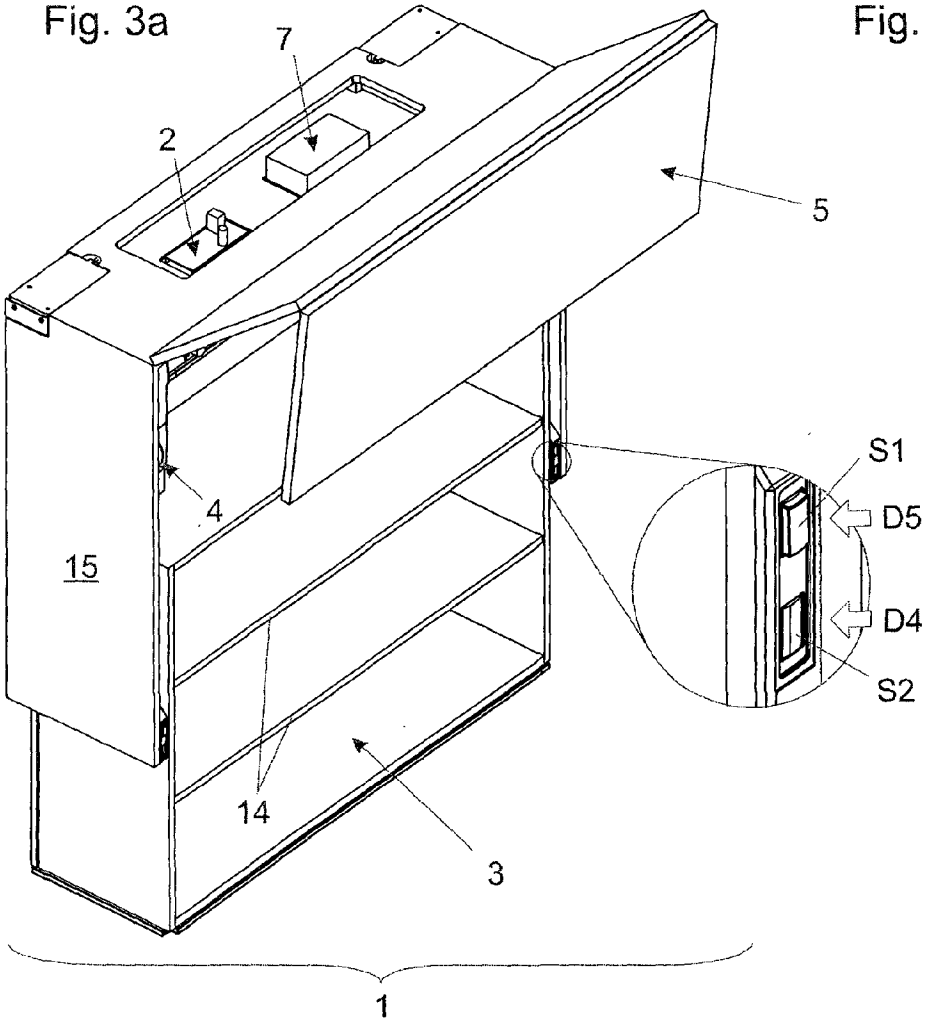

FIGS. 3*a* and 3*b* show the condition of the article of furniture 1, in which the flap 5 is completely open and the inner body 3 is moved completely down. The height-wise position of the inner body 3, which specifies the height-wise position of the inner body 3 relative to the remaining part (frame structure 15 and flap 5) of the article of furniture 1, is denoted by reference H in FIG. 3*b*.

Figure 4B:
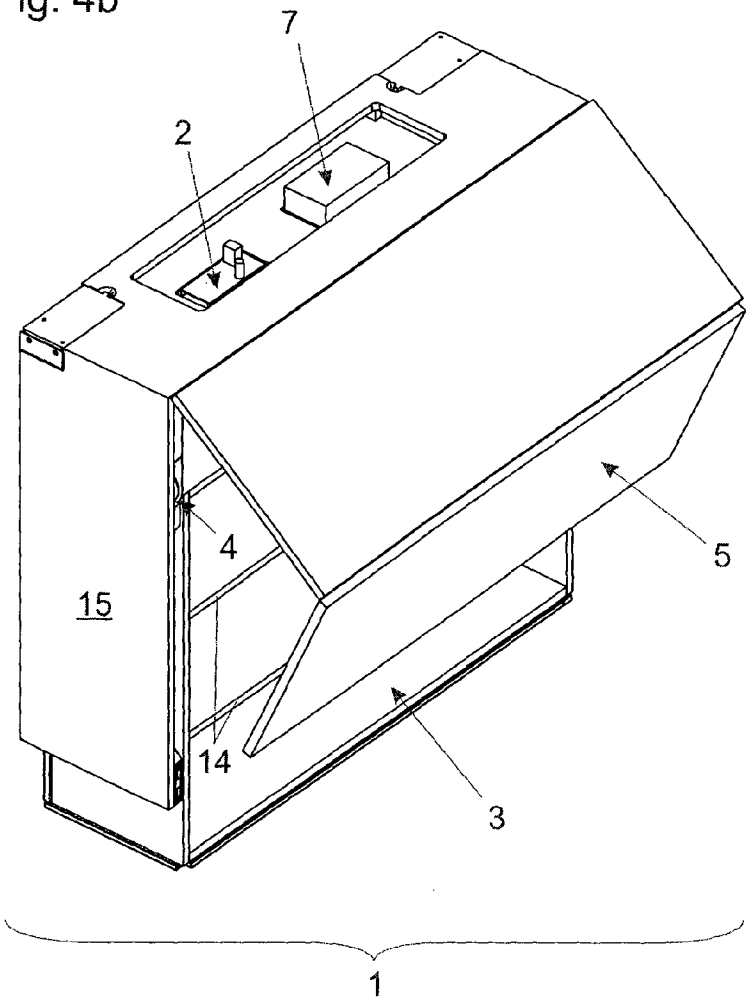
FIG. 4*b* is a diagrammatic perspective view of the preferred embodiment of the article of furniture with the flap partially closed and the inner body partially moved upwardly.
Figure 4A:
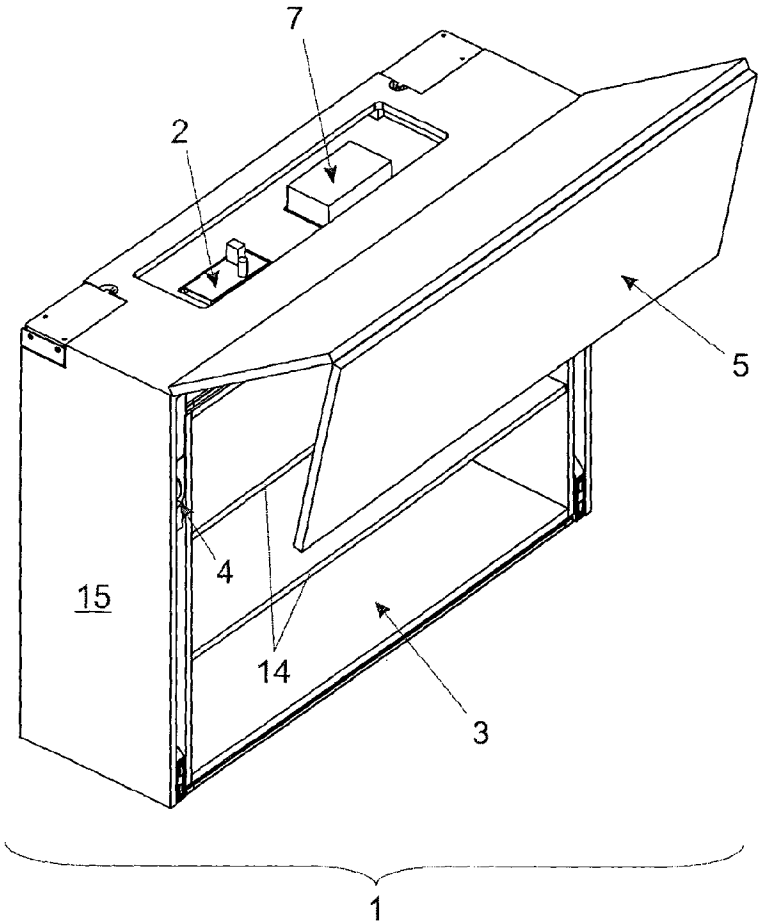
FIG. 4*a* is a diagrammatic perspective view of the preferred embodiment of the article of furniture with the flap open and the inner body moved upwardly.

In this condition of the article of furniture, the user once again has a choice between two operating options: on the one hand by renewed actuation D4 of the switch S2 he can again cause the inner body 3 to move upwardly again without the flap 5 closing, and on the other hand he has the option of causing both the inner body 3 to move upwardly and also the flap 5 to close, by applying pressure D5 to the switch S1. In this case, that combined closing movement of the article of furniture 1 is so coordinated that firstly the inner body 3 at least partially moves upwardly and it is only then that the flap 5 closes. The expression "at least partially" signifies that, in the course of that closing movement, firstly the inner body 3 moves completely upwardly and it is only then that the closing movement of the flap 5 begins (that situation is shown in FIG. 4*a*) or however the inner body 3 moves partially upwardly and then the closing movement of the flap 5 is triggered (see in that respect FIG. 4*b*). In both scenarios, the risk of fingers of the user being jammed by the relative movement of the inner body 3 and the flap 5 is excluded, as this arrangement ensures that, during the movement of the inner body 3, the spacing of the flap 5 relative to the inner body 3 does not fall below a given safety spacing. The flap 5 only completely approaches the inner body 3 when the latter has already come to a halt.

Figure 5:
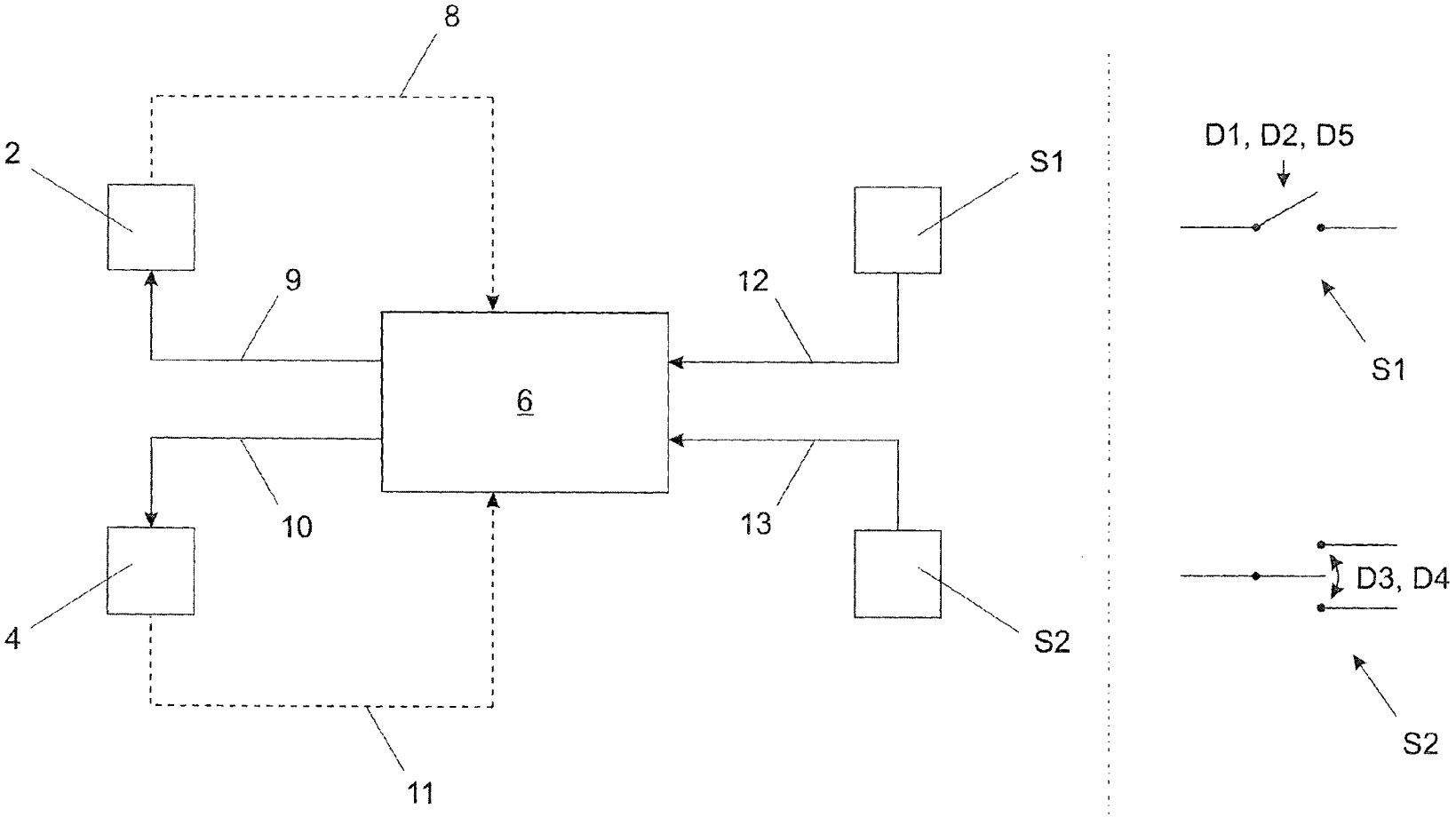
FIG. 5 is a diagrammatic view showing the principle to illustrate coordinated actuation of the flap motor and the body motor in the preferred embodiment of the article of furniture.

FIG. 5 serves to illustrate the coordinated actuation of the flap motor 4 and the body motor 2 in the preferred embodiment of the article of furniture. The central component part for implementing such coordinated actuation is the electronic control device 6 connected both to the body motor 2 and the flap motor 4 and also to the two actuating switches S1 and S2. In the simplest case, those connections 9 through 13 are electrical connections. By actuation of the two actuating switches S1 and S2, a user can give operating commands to the electronic control device 6, which thereupon actuates the two motors 2 and 4 in coordinated relationship, that coordination just for example involving the procedure wherein to close the article of furniture—starting from a position with the flap open and the inner body moved downwardly—firstly the inner body at least partially moves upwardly before the flap closes, or downward movement of the inner body is prevented when the flap is closed.

The two broken lines 8 and 11 show that the two motors 2 and 4 in this embodiment respectively function as a device for detecting the height-wise position of the inner body and for detecting the position of the flap, respectively. The motors 2, 4 feed those items of information about the height-wise position and the flap position back to the control device 6 (as indicated by the broken lines 8, 11). However, as already stated hereinbefore in the introductory part of this description, it is also possible to provide sensor devices which are separate from the motors for the purpose of providing feedback information.

The right-hand part of FIG. 5, which is separated off by the dash-dotted line, diagrammatically shows the two preferred embodiments of the actuating switches S1 and S2, the actuating switch S1 being a so-called "single pole/single throw" switch and the switch S2 being a so-called "single pole/double throw" switch.

Finally, it should also be noted that FIG. 5 only shows the underlying principle for coordinated actuation of the flap motor 4 and the body motor 5, and that all further electronic components which naturally are also still necessary for technical implementation (being however familiar to a man skilled in the art) have been omitted for the sake of clarity of the drawing.

The invention claimed is:

1. An article of furniture comprising:

an external frame structure;

a body motor;

an inner body configured to be raised and lowered relative to said external frame structure by said body motor;

a flap motor;

a flap articulated on said external frame structure and configured to cover a front side of said inner body when said inner body is in an upper position, said flap configured to be moved by said flap motor; and an electronic control device operable by at least one actuating switch, said electronic control device being configured to coordinate actuation of said flap motor and said body motor such that, when said flap is in an open position and said inner body is in a lower position, said electronic control device controls said flap motor and said body motor to partially move said inner body upwardly toward the upper position before controlling said flap motor to begin moving said flap into a closed position.

2. The article of furniture as set forth in claim 1, further comprising a detection device connected to said electronic control device for detecting a height-wise position of said inner body.

3. The article of furniture as set forth in claim 2, wherein said electronic control device is configured to actuate said flap motor and said body motor in a coordinated relationship based on the height-wise position of said inner body detected by said detection device.

4. The article of furniture as set forth in claim 1, wherein said electronic control device is configured to control said flap motor and said body motor to begin closure of said inner body and said flap after being triggered by a one-off actuation of said at least one actuating switch.

5. The article of furniture as set forth in claim 1, further comprising a detecting device connected to said electronic control device for detecting a position of said flap.

6. The article of furniture as set forth in claim 1, wherein said electronic control device is configured to prevent downward movement of said inner body when said flap is closed.

7. The article of furniture as set forth in claim 1, wherein at least one of said at least one actuating switch is located so as to be concealed by said flap when said flap is closed.

8. The article of furniture as set forth in claim 1, wherein said electronic control device is configured to control said body motor and said flap motor such that at least one of opening of said flap, downward movement of said inner body, upward movement of said inner body, and closure of said flap and inner body is begun by actuating said at least one actuating switch for a specific length of time different than other actuating lengths of time.

9. The article of furniture as set forth in claim 8, wherein said electronic control device is configured such that said at least one of opening of said flap, downward movement of said inner body, upward movement of said inner body, and closure of said flap and inner body is begun by different sequences of actuating pulses of said at least one actuating switch.

10. The article of furniture as set forth in claim 1, wherein said at least one actuating switch comprises at least two actuating switches, said electronic control device and said at least two actuating switches are configured such that:

opening and closing of said flap is begun by actuation of a first one of said at least two actuating switches; and upward and downward movement of said inner body is begun by actuation of a second one of said at least two actuating switches.

11. The article of furniture as set forth in claim 10, wherein said electronic control device is configured to control said flap motor and said body motor to begin closing said flap and said inner body by actuation of said first one of said at least two switches, wherein, when said flap is in an open position and said inner body is in a lower position, said electronic control device controls said flap motor and said body motor to partially move said inner body upwardly toward the upper position before controlling said flap motor to begin moving said flap into a closed position.

12. The article of furniture as set forth in claim 1, wherein said at least one actuating switch comprises two actuating switches located at respective left-hand and right-hand sides of said external frame structure.

13. The article of furniture as set forth in claim 1, wherein said at least one actuating switch is arranged so as to bear against an inside surface of said flap when said flap is closed so as to be actuated by external pressure on said flap.

14. The article of furniture as set forth in claim 1, wherein at least one of said at least one actuating switch is a pushbutton switch.

15. The article of furniture as set forth in claim 1, wherein at least one of said body motor and said flap motor is an electric motor.

16. The article of furniture as set forth in claim 1, wherein said inner body is configured such that at least a portion of said inner body is open.

17. The article of furniture as set forth in claim 1, wherein said inner body has at least one compartment shelf.

* * * * *